US008261431B2

(12) United States Patent
Iino et al.

(10) Patent No.: US 8,261,431 B2
(45) Date of Patent: Sep. 11, 2012

(54) METHOD FOR MANUFACTURING THERMAL HEAD

(75) Inventors: Daiki Iino, Kanagawa-ken (JP); Masato Sawada, Kanagawa-ken (JP); Atsunori Ando, Hokkaido (JP); Shigenori Kitamura, Hokkaido (JP); Taro Asakura, Hokkaido (JP)

(73) Assignees: Kabushiki Kaisha Toshiba, Tokyo (JP); Toshiba Hokuto Electronics Corporation, Asahikawa-shi (JP)

( * ) Notice: Subject to any disclaimer, the term of this patent is extended or adjusted under 35 U.S.C. 154(b) by 376 days.

(21) Appl. No.: 12/562,373

(22) Filed: Sep. 18, 2009

(65) Prior Publication Data

US 2010/0071198 A1 Mar. 25, 2010

(30) Foreign Application Priority Data

Sep. 24, 2008 (JP) ..... 2008-245010

(51) Int. Cl.
*H05B 3/00* (2006.01)

(52) U.S. Cl. ..... 29/611; 29/620; 29/621; 427/126.2; 427/402

(58) Field of Classification Search ..... 29/611, 29/613, 620, 621, 825, 846, 874; 347/171, 347/200, 203, 204, 206, 208, 209; 427/126.2, 427/126.4, 402, 579
See application file for complete search history.

(56) References Cited

U.S. PATENT DOCUMENTS

| | | | | |
|---|---|---|---|---|
| 6,441,839 | B1 * | 8/2002 | Masutani et al. | 347/203 |
| 7,876,343 | B2 * | 1/2011 | Yamade | 347/203 |

FOREIGN PATENT DOCUMENTS

| | | |
|---|---|---|
| JP | 4-8555 | 1/1992 |
| JP | 04-186801 | 7/1992 |
| JP | 10-149908 | 6/1998 |
| JP | 11-126701 | 5/1999 |
| JP | 2000-246935 | 9/2000 |
| JP | 2001-143903 | 5/2001 |
| JP | 3411133 | 3/2003 |
| JP | 3477194 | 9/2003 |
| JP | 2007-268970 | 10/2007 |

OTHER PUBLICATIONS

Japanese Office Action issued Jun. 11, 2012 in Japanese Counterpart Patent Application No. 2008-245010 (with English translation).

* cited by examiner

*Primary Examiner* — Thiem Phan
(74) *Attorney, Agent, or Firm* — Oblon, Spivak, McClelland, Maier & Neustadt, L.L.P.

(57) ABSTRACT

A method for manufacturing a thermal head, including: forming a resistance heating element and an electrode on an insulating substrate, the resistance heating element emitting heat by a current flowing the resistance heating element, the electrode being connected to the resistance heating element; forming a corrosion prevention layer on the resistance heating element and the electrode; annealing the resistance heating element; adjusting an electrical resistance of the resistance heating element; and forming a protective layer on the corrosion prevention layer, the protective layer having glass as a main component. The annealing is implemented prior to the adjusting. The forming the corrosion prevention layer is implemented prior to the annealing.

20 Claims, 10 Drawing Sheets

AFTER RESISTANCE VALUE ADJUSTMENT

AFTER PROTECTIVE LAYER FORMATION

AFTER RESISTANCE VALUE ADJUSTMENT

AFTER PROTECTIVE LAYER FORMATION

AFTER RESISTANCE VALUE ADJUSTMENT

AFTER PROTECTIVE LAYER FORMATION

METHOD FOR MANUFACTURING THERMAL HEAD

CROSS-REFERENCE TO RELATED APPLICATIONS

This application is based upon and claims the benefit of priority from the prior Japanese Patent Application No. 2008-245010, filed on Sep. 24, 2008; the entire contents of which are incorporated herein by reference.

BACKGROUND OF THE INVENTION

1. Field of the Invention

This invention relates to a method for manufacturing a thermal printer head (thermal head).

2. Background Art

A thermal head includes a resistance heating element and electrodes forming one circuit set multiply disposed in substantially straight line configurations on an insulating substrate made of ceramics, etc. A protective layer made of an insulative material is formed to cover at least the series of resistance heating elements. Printing is performed by providing pulse currents to the resistance heating elements to generate heat in a state where printing paper is pressed onto the upper face of the protective layer via an ink ribbon or in a state where thermal paper is pressed onto the upper face of the protective layer.

The protective layer may be formed by thin film formation methods typified by sputtering and thick film formation methods (film coating methods) typified by screen printing. Although protective layers formed by thin film formation methods have high heat resistance and thermal heads using such protective layers have excellent printing performance and durability, manufacturing costs are undesirably high. Therefore, the practical development of protective layers formed by film coating methods is expected to reduce costs. In film coating methods, a glass paste having glass as the main component is coated as a film, and sintering is subsequently performed to obtain a glass protective layer. Further, a corrosion prevention layer made of oxides, etc., may be provided between the glass protective layer and the resistance heating element and electrodes to prevent the resistance heating element and the electrodes from corroding during the sintering of the glass protective layer.

On the other hand, the resistance heating elements of the thermal head are multiply provided corresponding to the number of printed dots. In the case where the electrical resistance of the multiple resistance heating elements fluctuates, the amount of heat generated by each of the resistance heating elements is different, resulting in uneven optical density. To solve such problems, the resistance values of the resistance heating elements of the thermal head may be adjusted to prescribed values (JP-A 4-8555 (Kokai) (1992)). In such a method, a pulse voltage is applied to each of the resistance heating elements to change the electrical resistance value to the prescribed value. Generally, this resistance value adjustment (also referred to as "bit trimming") is performed after completion of the thermal head, that is, after forming the protective layer. Although the resistance value adjustment can be performed without problems in the case where the protective layer of the thermal head is formed by the thin film formation method providing a high heat resistance, the glass protective layer formed by the film coating method recited above undesirably melts due to heat emitted by the resistance heating elements during the resistance value adjustment.

Methods forming the glass protective layer by the film coating method after adjusting the resistance values may be considered. Although the electrical resistance of the resistance heating elements can be adjusted to the prescribed value by the resistance value adjustment in such a case, the electrical resistance undesirably varies due to the subsequent sintering at a high temperature during the glass protective layer formation process, and practical problems remain.

SUMMARY OF THE INVENTION

According to an aspect of the invention, there is provided a method for manufacturing a thermal head, including: forming a resistance heating element and an electrode on an insulating substrate, the resistance heating element emitting heat by a current flowing the resistance heating element, the electrode being connected to the resistance heating element; forming a corrosion prevention layer on the resistance heating element and the electrode; annealing the resistance heating element; adjusting an electrical resistance of the resistance heating element; and forming a protective layer on the corrosion prevention layer, the protective layer having glass as a main component, the annealing being implemented prior to the adjusting, and the forming the corrosion prevention layer being implemented prior to the annealing According to another aspect of the invention, there is provided a method for manufacturing a thermal head, including: forming a resistance heating element and an electrode on an insulating substrate, the resistance heating element emitting heat by a current flowing the resistance heating element, the electrode being connected to the resistance heating element; forming a corrosion prevention layer on the resistance heating element and the electrode; annealing the resistance heating element; adjusting an electrical resistance of the resistance heating element; and forming a protective layer on the corrosion prevention layer, the protective layer having glass as a main component, the annealing being implemented prior to the adjusting, and the annealing being implemented in a vacuum or in an inert gas.

DETAILED DESCRIPTION OF THE INVENTION

Embodiments of the invention will now be described with reference to the drawings.

First Embodiment

Figure 1:
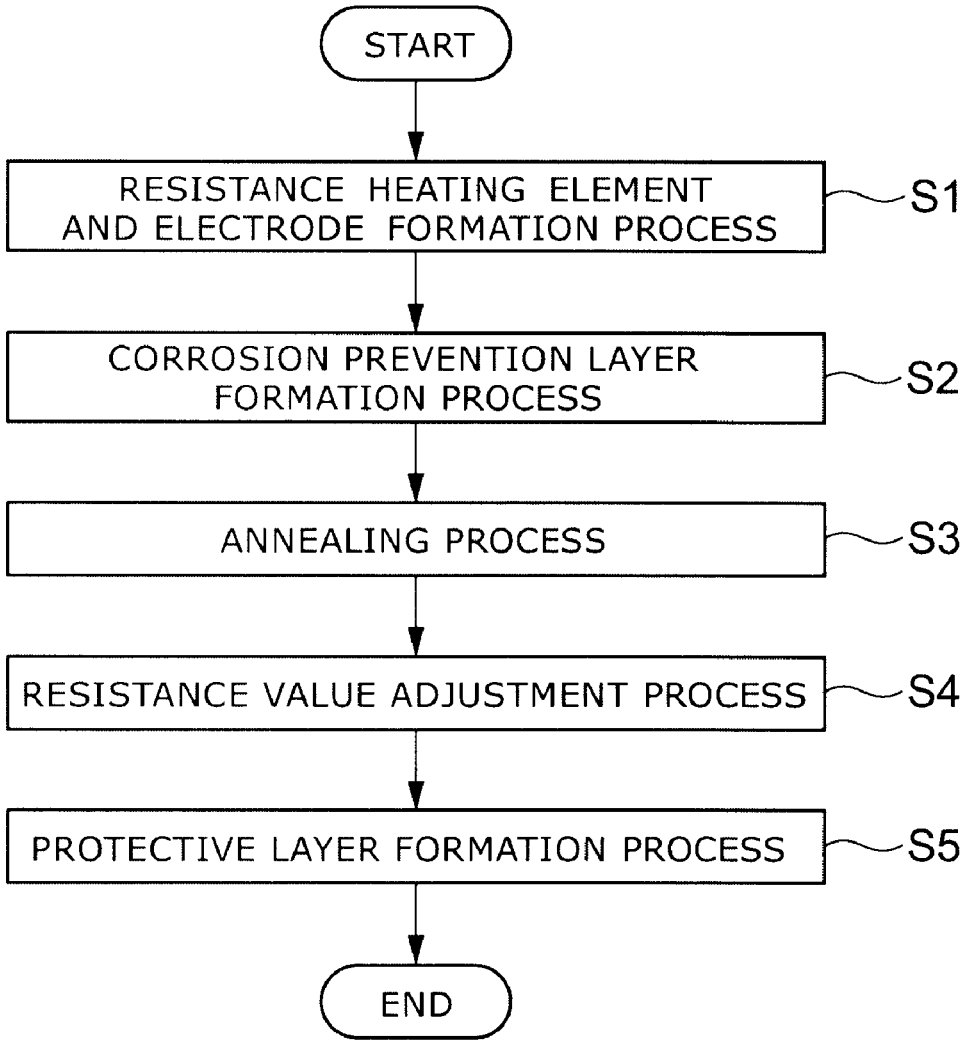
FIG. 1 is a flowchart illustrating a method for manufacturing a thermal head according to a first embodiment of the invention.

FIG. 1 is a flowchart illustrating a method for manufacturing a thermal head according to a first embodiment of the invention.

The manufacturing method of the first embodiment of the invention illustrated in FIG. 1 includes a first process S1 of forming a resistance heating element and an electrode; a second process S2 of forming a corrosion prevention layer on the resistance heating element and the electrode; a third process S3 of annealing the resistance heating element; a fourth process S4 of adjusting an electrical resistance of the resistance heating element; and a fifth process S5 of forming a protective layer on the corrosion prevention layer, where the protective layer includes glass as a main component. The third process S3 (the annealing) is implemented prior to the fourth process S4 (the adjusting). The second process S2 (the forming the corrosion prevention layer) is implemented prior to the third process S3 (the annealing).

Thereby, a thermal head can be obtained including an inexpensive glass protective layer that can withstand the resistance value adjustment process of the resistance heating element. A first example according to the first embodiment will now be described in detail.

First Example

Figure 2:
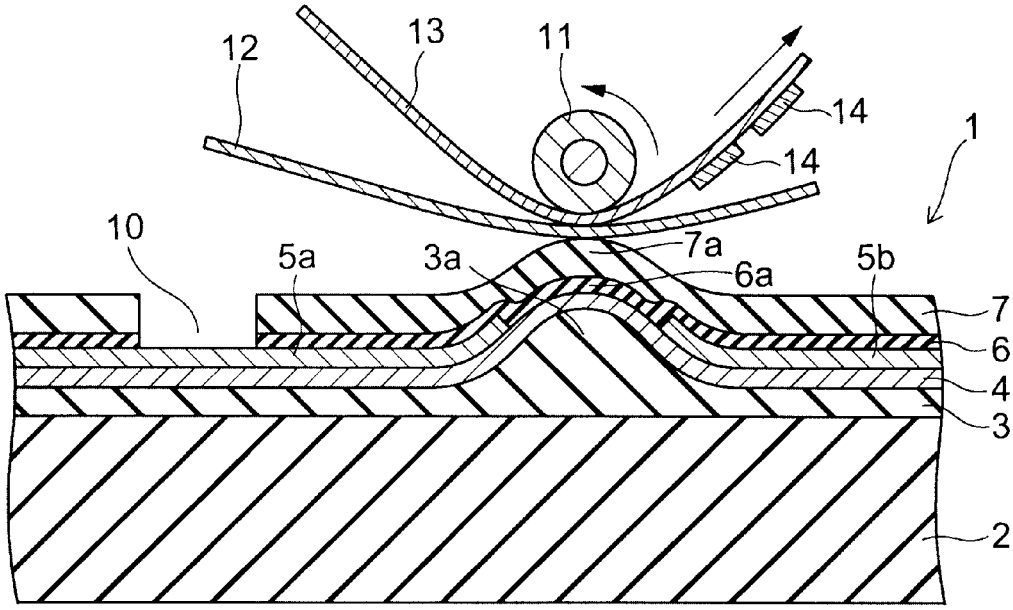
FIG. 2 is a partial cross-sectional view illustrating the structure of a thermal head manufactured by a first example of the invention.
Figure 3:
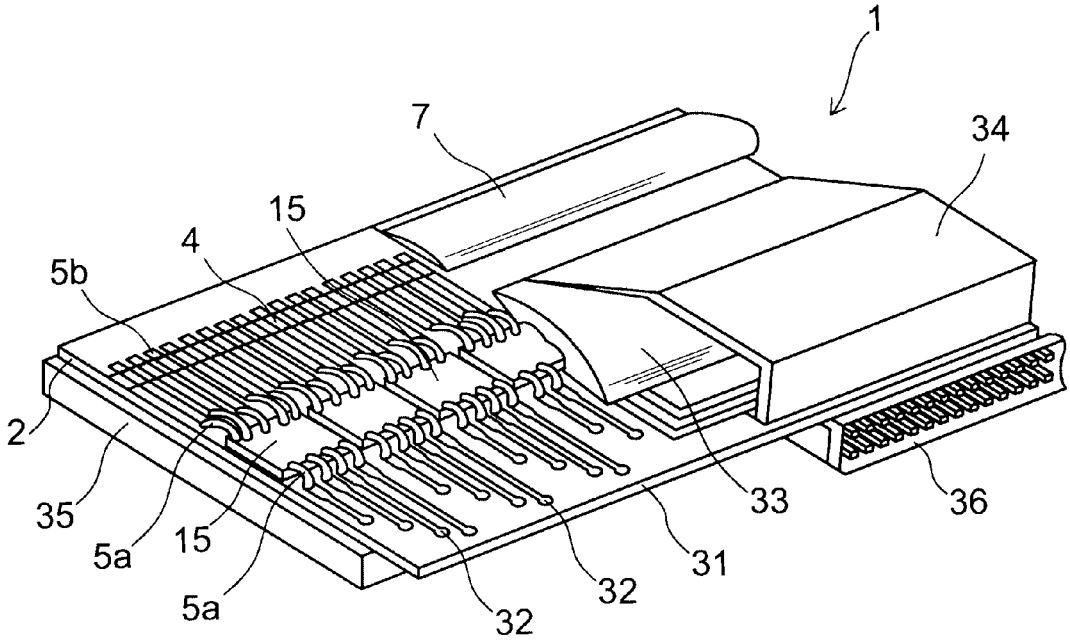
FIG. 3 is a partial perspective view illustrating the structure of the thermal head manufactured by the first example of the invention.

FIG. 2 and FIG. 3 are a partial cross-sectional view and a partial perspective view illustrating the structure of a thermal head manufactured by the first example of the invention.

As illustrated in FIG. 2, the thermal head 1 manufactured by this example includes an insulating substrate 2. An alumina ceramic substrate made of, for example, alumina may be used as the material of the insulating substrate 2. A glass layer 3 formed from, for example, water glass is provided on an upper face of the insulating substrate 2. A semicylindrical protrusion 3*a* aligned in one direction is formed on a portion of an upper face of the glass layer 3.

A resistance heating element 4 and electrodes 5*a* and 5*b* forming one circuit set are provided substantially in a straight line and multiply juxtaposed on the glass layer 3. The resistance heating element 4 may be formed as a thin film made of, for example, Ta—$SiO_2$. The electrodes 5*a* and 5*b* may be formed of a material having a main component of, for example, Al.

A corrosion prevention layer 6 and a protective layer 7 are provided to cover the glass layer 3, the resistance heating element 4, and the electrodes 5*a* and 5*b*. The configuration of the corrosion prevention layer 6 and the protective layer 7 reflect the configuration of the glass layer 3; and a protrusion 6*a* of the corrosion prevention layer 6 and a protrusion 7*a* of the protective layer 7 are formed in the region corresponding to the protrusion 3*a* of the glass layer 3. The corrosion prevention layer 6 may be formed of a material appropriately selected from an oxide, a nitride, and a compound thereof. The protective layer 7 may be formed by sintering a glass paste coated as a film, where the glass paste is made of glass frit, a binder, and a solvent.

As illustrated in FIG. 3, driver ICs (circuit devices) 15 are mounted on the insulating substrate 2. Terminals of each driver IC 15 are connected to end portions of the electrodes 5*a* on the side not connected to the resistance heating elements 4. For example, four of the electrodes 5*a* are connected to one driver IC 15. A resin substrate 31 is provided on the driver IC 15 side of the insulating substrate 2 to lie in the same plane as each of the upper face and the lower face of the insulating substrate 2. Multiple wiring layers 32 are formed on the resin substrate 31. The wiring layers 32 are connected to terminals of the driver IC 15 not connected to the electrodes 5*a*.

An encapsulation 33 made of resin is provided on the insulating substrate 2 and the resin substrate 31 to cover the driver ICs 15 and the portions of the electrodes 5*a* and the wiring layers 32 connected to the driver ICs 15. An IC cover 34 formed by, for example, bending a resin plate is provided to cover the encapsulation 33. On the other hand, a heat sink 35 and a connector 36 are linked to the lower face of the insulating substrate 2 and the resin substrate 31. Terminals of the connector 36 are connected to the wiring layers 32.

Operations of the thermal head 1 having such a configuration will now be described with reference to FIG. 2.

As illustrated in FIG. 2, a roller 11 is disposed above the protrusion 7*a* of the protective layer 7. An ink ribbon 12 and printing paper 13 are disposed between the roller 11 and the protrusion 7*a* of the protective layer 7. The ink ribbon 12 is pressed onto the protrusion 7*a* by the roller 11 via the printing paper 13. Here, as the roller 11 rotates, the ink ribbon 12 and the printing paper 13 move with respect to the thermal head 1, and the ink ribbon 12 slides on the protrusion 7*a*.

In this state, the driver ICs 15 selectively provide pulse currents to paths formed of the electrodes 5*a*, the resistance heating elements 4, and the electrodes 5*b* based on signals input via the connector 36. Each pulse current flows through the resistance heating element 4 directly below the protrusion 7*a*, and the resistance heating element 4 generates heat. The heat is conducted through the corrosion prevention layer 6 and the protective layer 7 to a portion of the ink ribbon 12 contacting the protrusion 7*a*, and an ink component in the ink ribbon 12 is transferred to the printing paper 13. An ink layer 14 is thereby formed on the printing paper 13, and printing is performed.

Details of the method for manufacturing the thermal head of the first example will now be described.

The method for manufacturing the thermal head of the first example has the configuration illustrated by the flowchart of FIG. 1 described above. FIGS. 4A to 4E are cross-sectional views of each stage of the manufacturing processes of the thermal head of the first example of the invention.

Figure 4A:
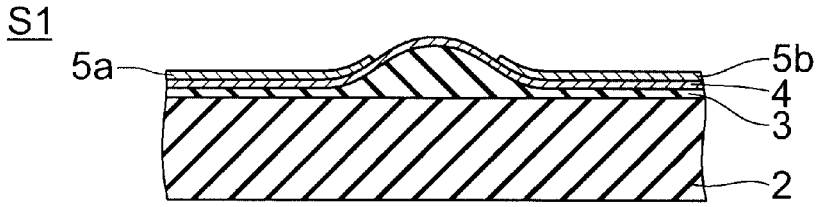
FIGS. 4A to 4E are cross-sectional views of each stage of manufacturing processes of the thermal head of the first example of the invention.

First, in the first process S1 illustrated in FIG. 4A, water glass, for example, is coated and sintered on the insulating substrate 2 to form the glass layer 3 including the semicylindrical protrusion 3*a* aligned in one direction. Then, sputtering is used to form the resistance heating element layer made of, for example, Ta—$SiO_2$ with a thickness of 0.05 μm (micrometers). An electrode layer made of, for example, Al is then formed with a thickness of 0.75 μm on the resistance heating element layer. The resistance heating element 4 and the electrodes 5*a* and 5*b* are formed by patterning. One circuit set formed of the resistance heating element 4 and the electrodes 5*a* and 5*b* is provided in substantially a straight line configuration and multiply juxtaposed. Thus, the forming the resistance heating element 4 and the electrodes 5*a* and 5*b* includes forming a resistance heating layer to form the resistance heating element 4 on the protrusion 3*a* of the glass layer 3 provided on the insulating substrate 2.

Figure 4B:
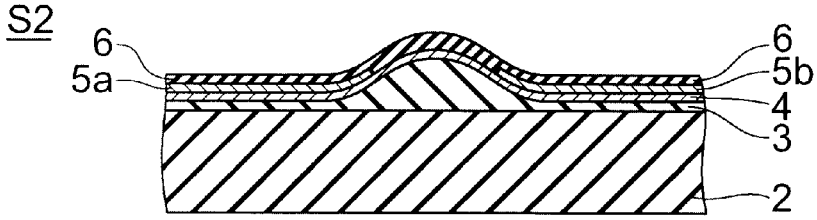

The corrosion prevention layer 6 is then formed in the second process S2 illustrated in FIG. 4B. The corrosion prevention layer 6 is formed by sputtering a film of, for example, aluminum oxide ($Al_2O_3$) with a thickness of 200 nm.

Figure 4C:
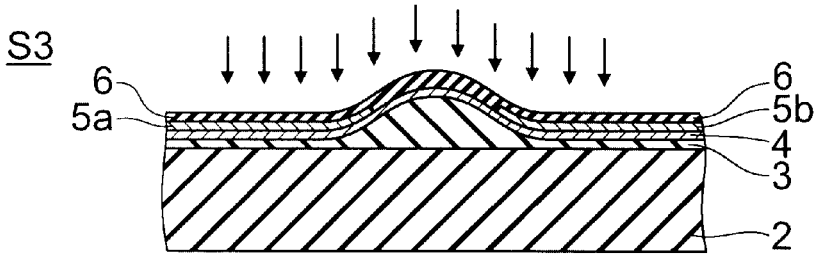

The resistance heating element 4 is then annealed in the third process S3 illustrated in FIG. 4C. The annealing may be performed, for example, in ambient air at 600° C. for 30 minutes.

Figure 4D:
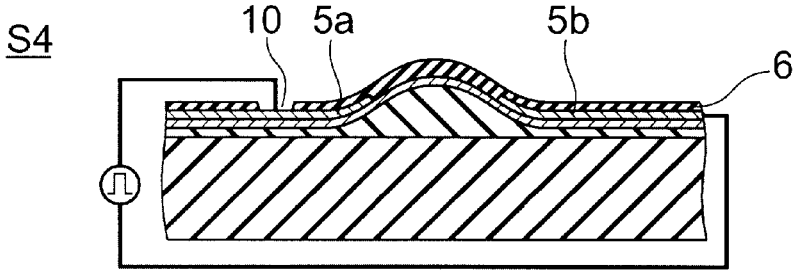

Continuing in the fourth process S4 illustrated in FIG. 4D, the electrical resistance values of the resistance heating elements 4 are adjusted to prescribed values by providing currents to the circuits formed of the resistance heating element 4 and the electrodes 5*a* and 5*b*. This adjustment is performed by measuring the electrical resistance of each of the multiple circuits formed of the resistance heating element 4 and the electrodes 5*a* and 5*b* and providing each circuit with a current matched to the electrical resistance of the respective circuit formed of the resistance heating element 4 and the electrodes 5*a* and 5*b*. As illustrated in FIG. 4D, photolithography and etching are used to make contact holes 10 at prescribed locations prior to the adjusting (the resistance value adjustment process of the resistance heating element 4).

Figure 4E:
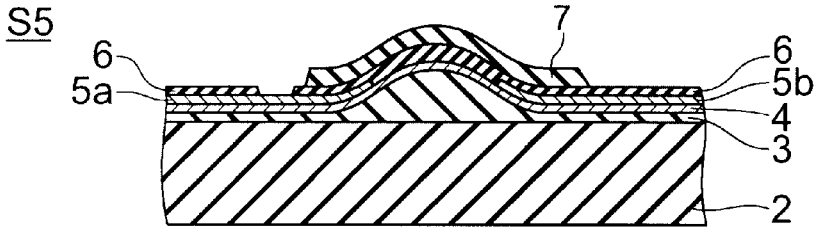

The glass protective layer 7 is then formed in a prescribed configuration on the corrosion prevention layer 6 in the fifth process S5 illustrated in FIG. 4E. The protective layer 7 can be obtained with a film thickness of 8 μm by using screen printing to form a glass paste in a prescribed configuration and performing sintering at 430° C. for 30 minutes, where the glass paste is made of, for example, a known glass frit having components such as $B_2O_3$, an organic vehicle binder having ethyl cellulose as the main component, and a solvent having a terpineol as the main component.

Measurement results will now be described for the electrical resistance of the circuits formed of the resistance heating element 4 and the electrodes 5*a* and 5*b* for the thermal heads 1 formed by the manufacturing method of the first example described above.

Figure 5A:
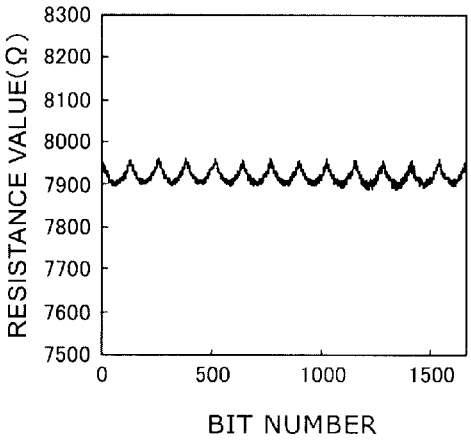
FIGS. 5A and 5B are graphs illustrating the change of the resistance value of the thermal head according to the first example of the invention.
Figure 5B:
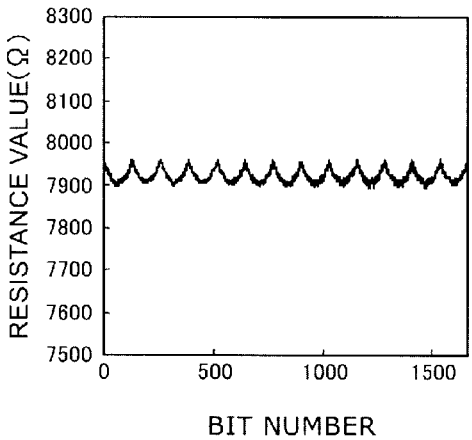

FIGS. 5A and 5B are graphs illustrating the change of the electrical resistance of the thermal heads 1 according to the first example. FIG. 5A illustrates the measurement result of the resistance values directly after the fourth process S4 (the adjusting). The bit numbers of multiple thermal heads are plotted on the horizontal axis, and the resistance values of the circuits are plotted on the vertical axis. Although the resistance values illustrated in FIG. 5A change periodically every 128 bits, the values as an entirety are constant. The reason that the resistance values change periodically is as follows. Namely, the resistance values illustrated in FIG. 5A indicate the resistance between measurement pads of the circuits formed of the resistance heating element 4 and the electrodes 5*a* and 5*b*. On the other hand, the total wiring resistance from the circuits formed of the resistance heating element 4 and the electrodes 5*a* and 5*b* to the driver IC is designed to be constant. As a result, the resistance between measurement pads of the circuits formed of the resistance heating element 4 and the electrodes 5*a* and 5*b* is designed to change periodically every 128 bits.

FIG. 5B illustrates the measurement results of the resistance values after the fifth process S5 (the forming the protective layer). Comparing FIGS. 5A and 5B shows that substantially no changes occurred in the electrical resistance of the circuits formed of the resistance heating element 4 and the electrodes 5*a* and 5*b* of the thermal heads 1 formed by the manufacturing method of the first example after the fourth process S4 (the adjusting) and after the fifth process S5 (the forming the protective layer). The reason for this lack of change is as follows. Namely, the film structure of the resistance heating element 4 was stabilized during the third process S3 (the annealing) for the thermal head 1 formed by the manufacturing method of the invention because the third process S3 (the annealing) was provided prior to the fourth process S4 (the adjusting). Therefore, the film structure of the resistance heating element 4 was not changed by the subsequent thermal load of the fifth process S5 (the forming the protective layer). Thus, the first example can use an inexpensive glass protective layer to provide a thermal head capable of withstanding the resistance value adjustment process of the resistance heating element and having excellent printing performance and durability.

In the first example, a thermal history is provided beforehand to the resistance heating element 4 in the third process S3 to suppress changes of the properties of the film of the resistance heating element 4 due to the thermal load during the forming the protective layer 7 in the fifth process S5. Accordingly, the temperature of the third process S3 (the annealing) is set substantially equal to or higher than the temperature of the fifth process S5 (the forming the protective layer). Simultaneously, the temperature of the third process S3 (the annealing) is set lower than the deformation temperature of the members forming the thermal head. In the case of the first example, the annealing conditions of the second process S2 are 600° C. for 30 minutes; the sintering conditions of the protective layer during the fifth process S5 are 430° C. for 30 minutes; and the melting point of the electrode material Al, which has the lowest heat resistance of the members forming the thermal head, is 660° C. Thus, the temperature of the third process S3 is set to be not less than the temperature of the fifth process S5 and lower than the deformation temperature of the members forming the thermal head.

First Comparative Example

A first comparative example will now be described.

Figure 6:
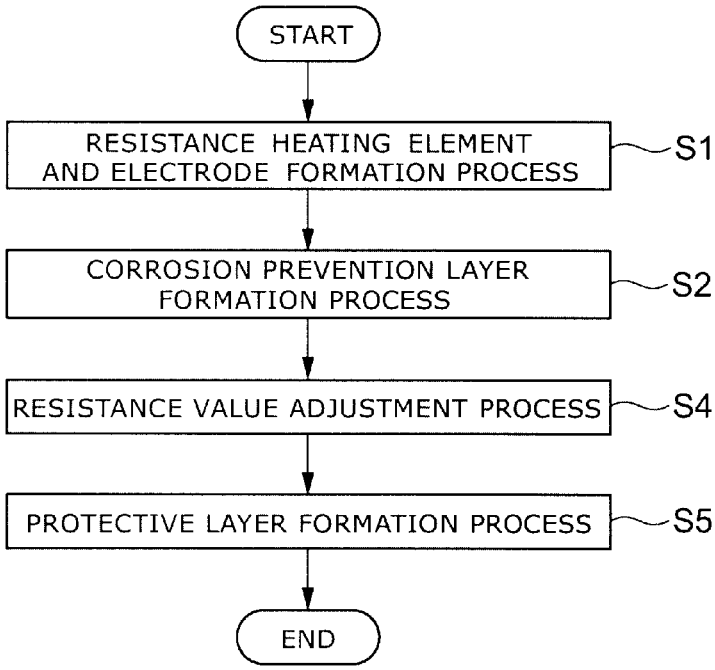
FIG. 6 is a flowchart of a method for manufacturing a thermal head of a first comparative example.
Figure 7A:
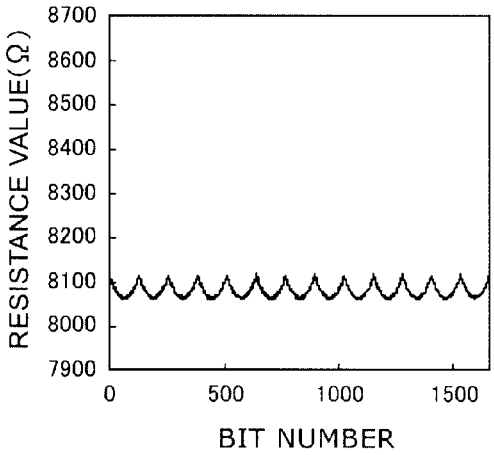
FIGS. 7A and 7B are graphs illustrating the change of the electrical resistance of the thermal head of the first comparative example.
Figure 7B:
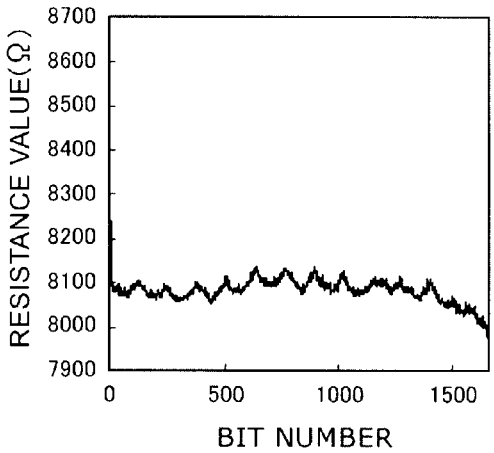

FIG. 6 is a flowchart of a method for manufacturing a thermal head of the first comparative example. The first comparative example did not include the third process S3 (annealing), and the fourth process S4 (the adjusting) was implemented after the second process S2 (the forming the corrosion prevention layer). FIGS. 7A and 7B illustrate the measurement results of the electrical resistances of the circuits formed of the resistance heating element 4 and the electrodes 5*a* and 5*b* for this case. FIGS. 7A and 7B are graphs illustrating the change of the electrical resistance of the thermal heads 1 of the first comparative example. FIG. 7A illustrates the measurement values after the fourth process S4 (the adjusting). FIG. 7B illustrates the resistance values after the fifth process S5 (the forming the protective layer). The resistance values after the fourth process S4 (the adjusting) illustrated in FIG. 7A are constant over all of the bit numbers (excluding the periodicity every 128 bits), while the resistance values after the fifth process S5 (the forming the protective layer) illustrated in FIG. 7B have extremely large fluctuations. This change of the resistance values is because the film structures of the resistance heating elements 4 changed due to the thermal load during the fifth process S5 (the forming the protective layer), thereby causing the resistance values which had been adjusted to constant values to change after the fifth process S5.

Second Example

A second example according to the first embodiment of the invention will now be described. In the second example, the aluminum oxide ($Al_2O_3$) corrosion prevention layer 6 of the first example is changed to silicon oxynitride ($SiO_xN_y$) having a thickness of 200 nm. Otherwise, the thermal head manufactured by the second example is similar to that of the first example.

Figure 8A:
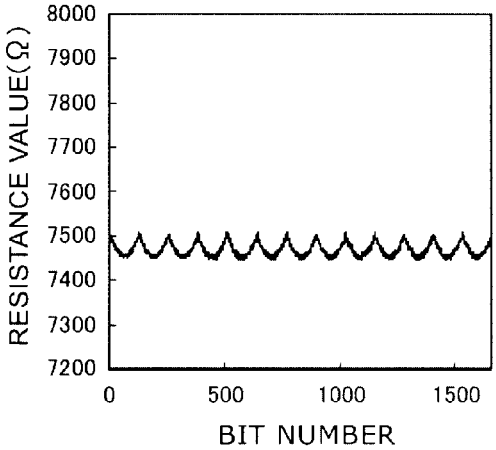
FIGS. 8A and 8B are graphs illustrating the change of the resistance value of the thermal heads of a second example of the invention.
Figure 8B:
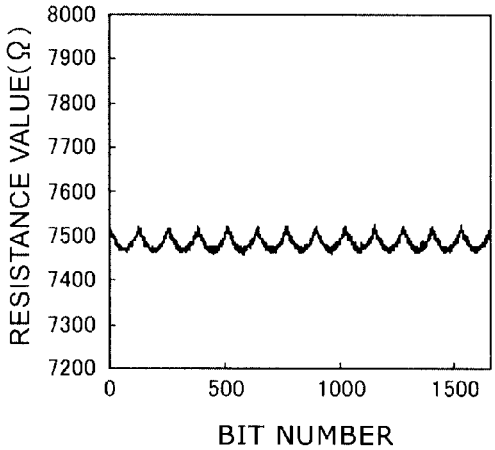

FIGS. 8A and 8B are graphs illustrating the change of the electrical resistance of the thermal heads 1 of the second example. FIG. 8A illustrates the measurement values after the fourth process S4 (the adjusting). FIG. 8B illustrates the resistance values after the fifth process S5 (the forming the protective layer). Comparing FIGS. 8A and 8B shows that substantially no changes occurred in the electrical resistance values of the circuits formed of the resistance heating elements 4 and the electrodes 5*a* and 5*b* of the thermal heads 1 of the second example after the fourth process S4 (the adjusting) and after the fifth process S5 (the forming the protective layer).

Second Embodiment

A method for manufacturing a thermal head according to a second embodiment of the invention will now be described.

Figure 9:
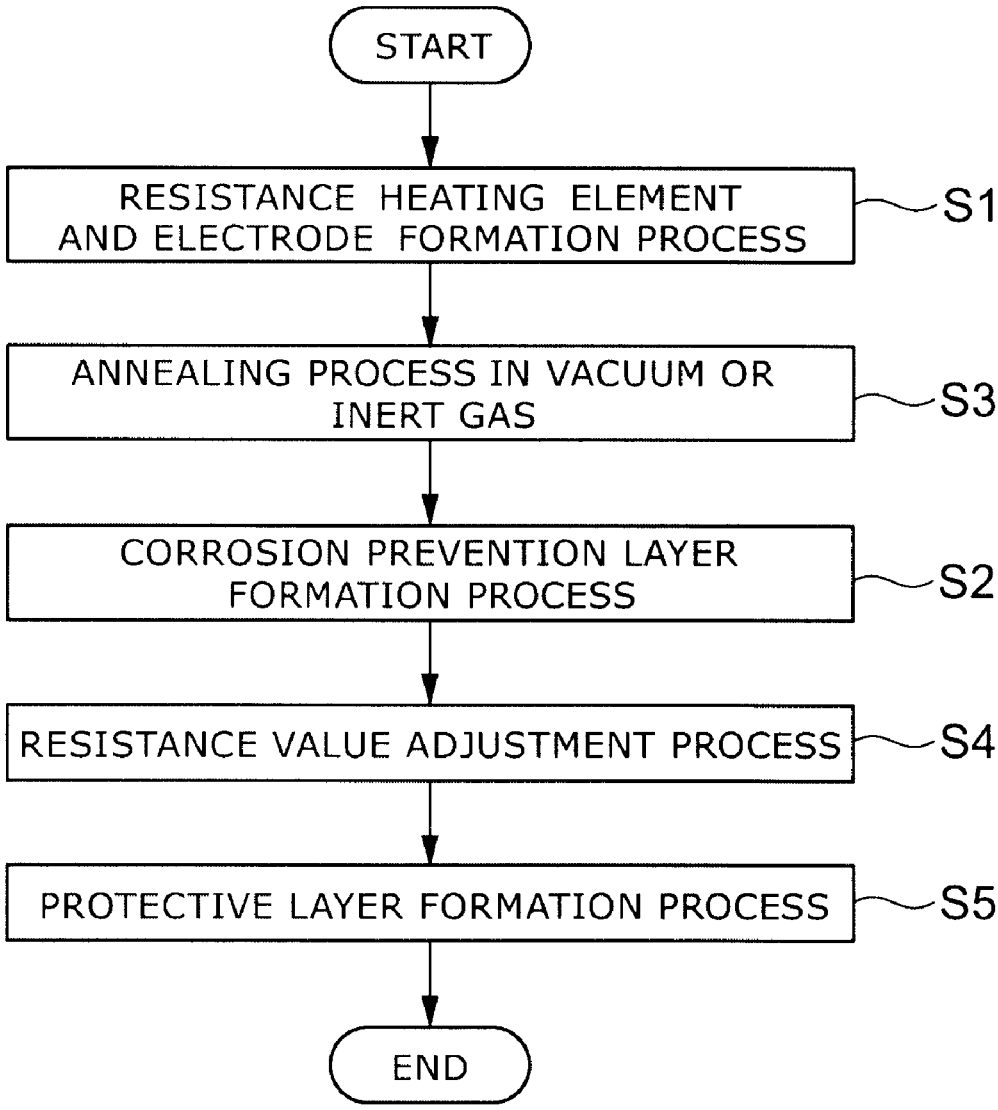
FIG. 9 is a flowchart illustrating a method for manufacturing a thermal head according to a second embodiment of the invention.

FIG. 9 is a flowchart illustrating the method for manufacturing the thermal head according to the second embodiment of the invention. The method for manufacturing the thermal head of the second embodiment of the invention illustrated in FIG. 9 includes: implementing the first process S1 of forming the resistance heating element 4 and the electrodes 5*a* and 5*b*; implementing the third process S3 of annealing the resistance heating element 4; implementing the second process S2 of forming the corrosion prevention layer 6 on the resistance heating element 4 and the electrodes 5*a* and 5*b*; implementing the fourth process S4 of adjusting an electrical resistance of the resistance heating element 4; and implementing the fifth process S5 of forming the protective layer 7 having glass as the main component on the corrosion prevention layer 6. In other words, the third process S3 (the annealing) is implemented prior to the fourth process S4 (the adjusting). Also, the third process S3 (the annealing) is implemented in a vacuum or in an inert gas.

Third Example

A third example according to the second embodiment of the invention will now be described in detail.

FIGS. 10A to 10E are cross-sectional views of each stage of manufacturing processes of the thermal head of the third example.

Figure 10A:
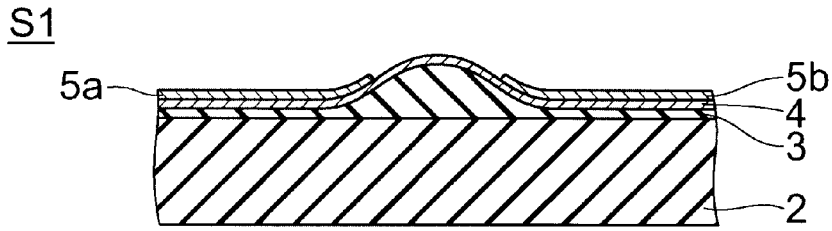
FIGS. 10A to 10E are cross-sectional views of each stage of manufacturing processes of a thermal head of a third example.

First, in the first process S1 illustrated in FIG. 10A, the glass layer 3, the resistance heating element 4 made of Ta—$SiO_2$, and the electrodes 5*a* and 5*b* made of Al are formed on the insulating substrate 2 similarly to the methods described above.

Figure 10B:
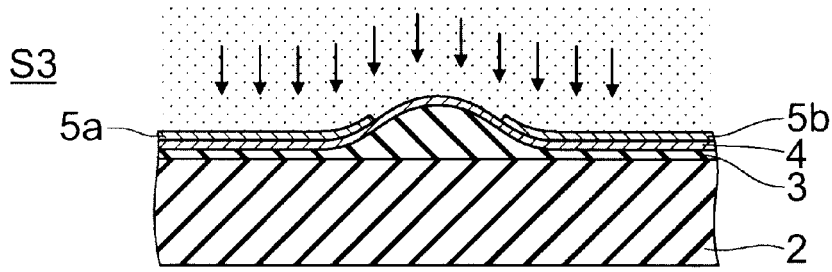

The resistance heating element 4 is then annealed in a vacuum or in an inert gas in the third process S3 illustrated in FIG. 10B. In this example, the annealing was performed in $N_2$ at the high temperature of 550° C. for 30 minutes.

Figure 10C:
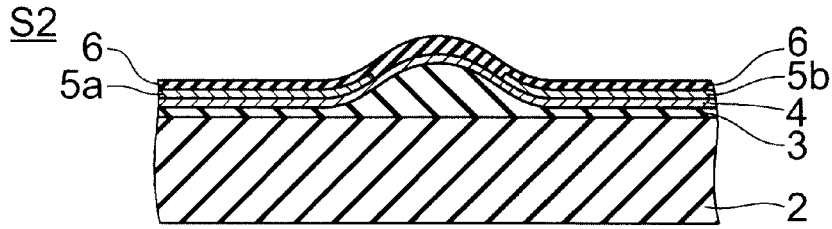

The corrosion prevention layer 6 is then formed in the second process S2 illustrated in FIG. 10C. The corrosion prevention layer 6 is formed by sputtering a film of, for example, silicon oxynitride ($SiO_xN_y$) with a thickness of 200 nm.

Figure 10D:
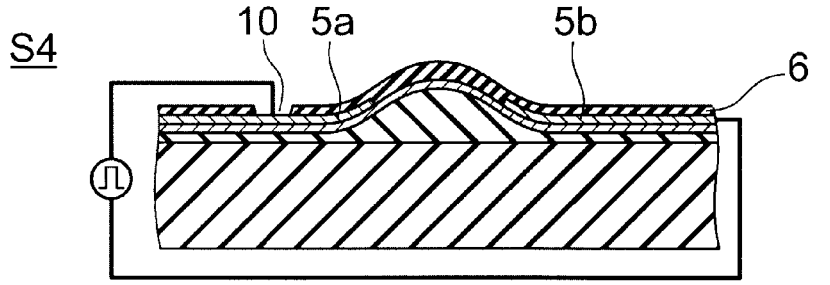

Continuing in the fourth process S4 illustrated in FIG. 10D, the electrical resistance values of the resistance heating elements 4 are adjusted to prescribed values by providing currents to the circuits formed of the resistance heating element 4 and the electrodes 5*a* and 5*b*. The contact holes 10 are made beforehand at prescribed locations.

Figure 10E:
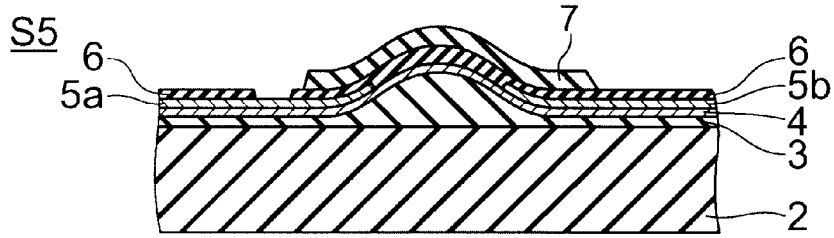

The glass protective layer 7 is then formed in a prescribed configuration on the corrosion prevention layer 6 in the fifth process S5 illustrated in FIG. 10E. The glass protective layer 7 can be obtained with a film thickness of 5 μm by using screen printing to form a glass paste in a prescribed configuration and performing sintering at 430° C. for 30 minutes.

Measurements of the electrical resistance of the circuits formed of the resistance heating element 4 and the electrodes 5*a* and 5*b* of the thermal heads 1 formed by the manufacturing method of the third example described above showed that the electrical resistance of the circuits formed of the resistance heating element 4 and the electrodes 5*a* and 5*b* had substantially no change after the fourth process S4 (the adjusting) and after the fifth process S5 (the forming the protective layer). The reason for this lack of change is because the film structure of the resistance heating element 4 was stabilized by providing the third process S3 (the annealing) prior to the fourth process S4 (the adjusting) in the manufacturing method of the third example. Therefore, change did not occur by the subsequent thermal load of the fifth process S5 (the forming the protective layer). Thus, the third example can use an inexpensive glass protective layer to provide a thermal head capable of withstanding the resistance value adjustment process of the resistance heating element and having excellent printing performance and durability.

The reason for annealing the resistance heating element 4 in $N_2$ in the third process S3 in the third example is as follows. In the third example, the annealing process is implemented prior to forming the corrosion prevention layer 6. Therefore, the annealing is performed at a high temperature in a state where the resistance heating element 4 and the electrodes 5*a* and 5*b* are exposed. The annealing is performed in $N_2$ to prevent oxidation and corrosion of the resistance heating element 4 and the electrodes 5*a* and 5*b* during the annealing. Thus, in the case where the third process S3 (the annealing) is implemented prior to the second process S2 (the forming the corrosion prevention layer), the third process S3 is implemented in a vacuum or in an inert gas atmosphere to prevent oxidization and corrosion of the resistance heating element 4 and the electrodes 5*a* and 5*b*.

The temperature of the third process S3 (the annealing) of the third example is set substantially equal to or higher than the temperature of the fifth process S5 (the forming the protective layer). Simultaneously, the temperature of the third process S3 (the annealing) is set lower than the deformation temperature of the members forming the thermal head.

The method for manufacturing the thermal head according to the third embodiment of the invention will now be described.

Figure 11:
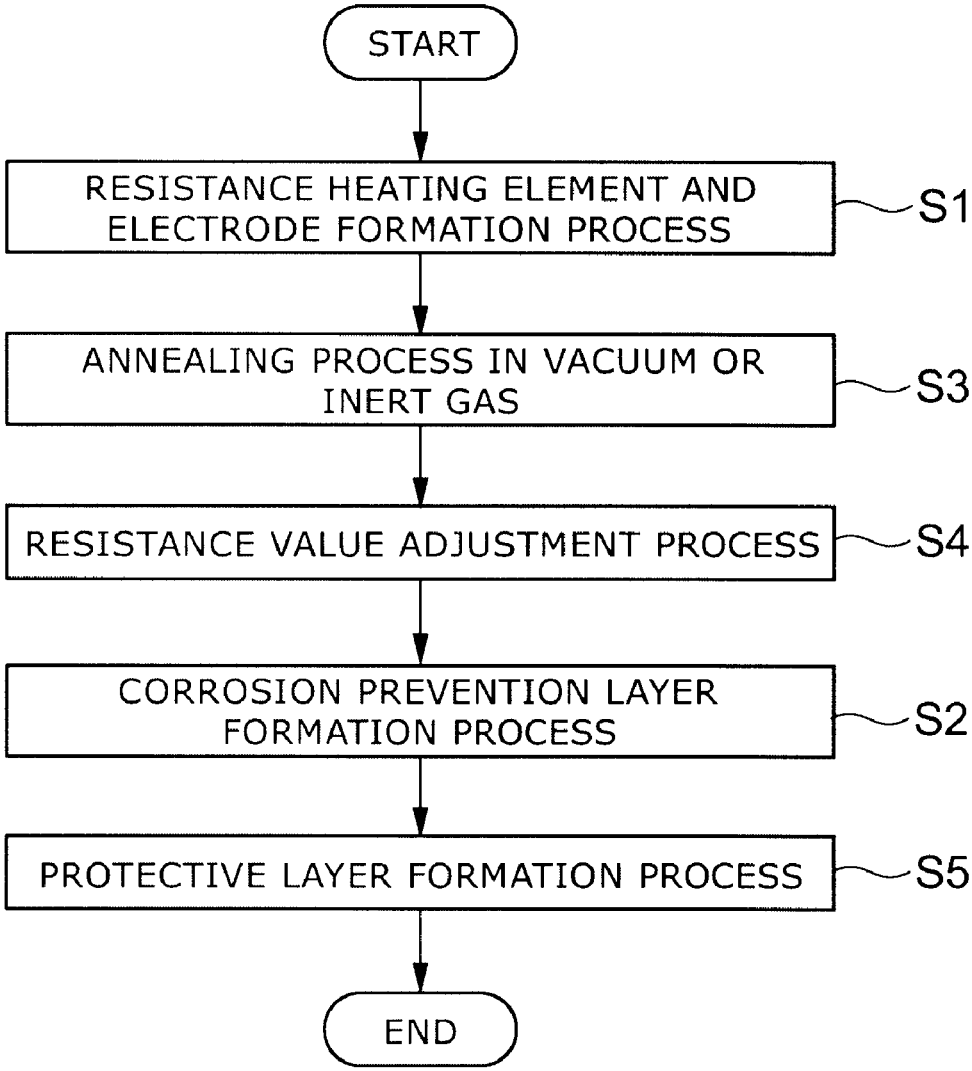
FIG. 11 is a flowchart illustrating a method for manufacturing a thermal head according to a third embodiment of the invention.

FIG. 11 is a flowchart illustrating the method for manufacturing the thermal head according to the third embodiment of the invention. The method for manufacturing the thermal head of the third embodiment of the invention illustrated in FIG. 11 includes: implementing the first process S1 of forming the resistance heating element 4 and the electrodes 5*a* and 5*b*; implementing the third process S3 of annealing the resistance heating element 4; implementing the fourth process S4 of adjusting the electrical resistance of the resistance heating element 4; implementing the second process S2 of forming the corrosion prevention layer 6 on the resistance heating element 4 and the electrodes 5*a* and 5*b*; and implementing the fifth process S5 of forming the protective layer 7 having glass as the main component on the corrosion prevention layer 6. In other words, the third process S3 (the annealing) is implemented prior to the fourth process S4 (the adjusting). The third process S3 (the annealing) is implemented in a vacuum or in an inert gas.

Fourth Example

A fourth example according to the third embodiment of the invention will now be described in detail.

FIGS. 12A to 12E are cross-sectional views of each stage of manufacturing processes of the thermal head of the fourth example.

Figure 12A:
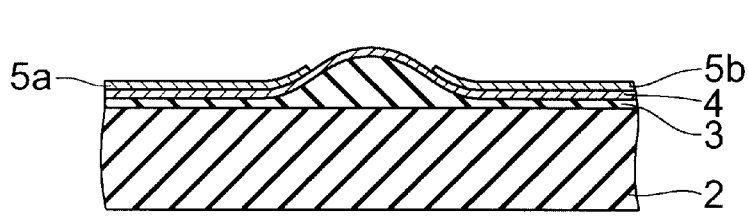
FIGS. 12A to 12E are cross-sectional views of each stage of manufacturing processes of a thermal head of a fourth example.

First, in the first process S1 illustrated in FIG. 12A, the glass layer 3, the resistance heating element 4 made of Ta—$SiO_2$, and the electrodes 5*a* and 5*b* made of Al are formed on the insulating substrate 2 similarly to the methods described above.

Figure 12B:
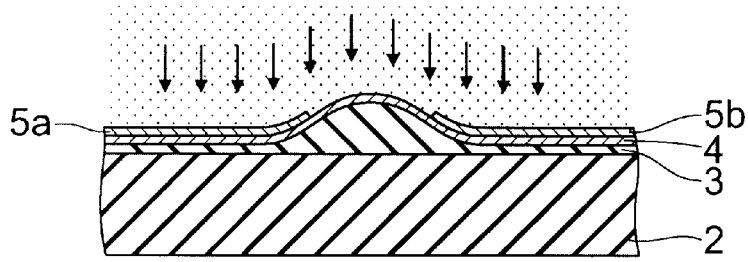

The resistance heating element 4 is then annealed in the third process S3 illustrated in FIG. 12B. In this case, the annealing is performed in $N_2$ at the high temperature of 550° C. for 30 minutes.

Figure 12C:
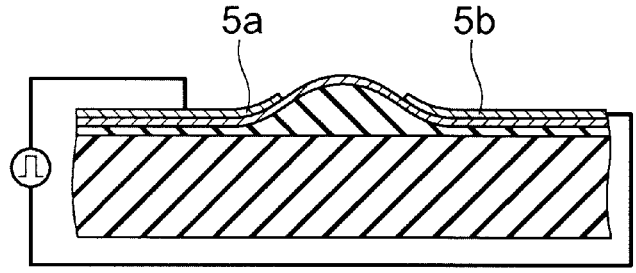

Continuing in the fourth process S4 illustrated in FIG. 12C, the electrical resistance values of the resistance heating elements 4 are adjusted to prescribed values by providing currents to the circuits formed of the resistance heating element 4 and the electrodes 5*a* and 5*b*.

Figure 12D:
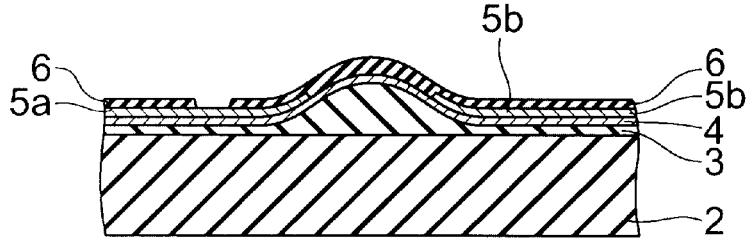

The corrosion prevention layer 6 is then formed in the second process S2 illustrated in FIG. 12D. The corrosion prevention layer 6 is formed by sputtering a film of, for example, $SiO_xN_y$ with a thickness of 200 nm.

Figure 12E:
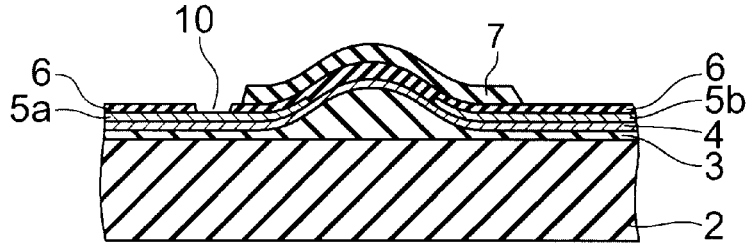

The glass protective layer 7 is then formed in a prescribed configuration on the corrosion prevention layer 6 in the fifth process S5 illustrated in FIG. 12E. The glass protective layer 7 can be obtained with a film thickness of 5 μm by using screen printing to form a glass paste in a prescribed configuration and performing sintering at 430° C. for 30 minutes. The contact holes 10 are made in the corrosion prevention layer 6 for connections to an external drive circuit.

The electrical resistance of the circuits formed of the resistance heating element 4 and the electrodes 5*a* and 5*b* of the thermal heads 1 formed by the manufacturing method of the fourth example described above had substantially no change after the fourth process S4 (adjusting) and after the fifth process S5 (the forming the protective layer). The reason for this lack of change is because the film structure of the resistance heating element 4 was stabilized by providing the third process S3 (the annealing) prior to the fourth process S4 (the adjusting) for the thermal head formed by the manufacturing method of the fourth example. Therefore, change did not occur by the subsequent thermal load of the fifth process S5 (the forming the protective layer). Thus, the fourth example can use an inexpensive glass protective layer to provide a thermal head capable of withstanding the resistance value adjustment process of the resistance heating element and having excellent printing performance and durability.

In the case of the fourth example as described above, the third process S3 (the annealing) is implemented prior to the second process S2 (the forming the corrosion prevention layer). Therefore, the third process S3 is implemented in a vacuum or in an inert gas atmosphere to prevent oxidation and corrosion of the resistance heating element 4 and the electrodes 5*a* and 5*b*. Also, the fourth process S4 (the adjusting) is implemented prior to the second process S2 (the forming the corrosion prevention layer). Therefore, it is better that the fourth process S4 (adjusting) is implemented in a vacuum or in an inert gas atmosphere so that oxidization and corrosion of the resistance heating element 4 do not occur easily in the fourth process S4 (the adjusting).

The temperature of the third process S3 (the annealing) of the fourth example also is set substantially equal to or higher than the temperature of the fifth process S5 (the forming the protective layer). Simultaneously, the temperature of the third process S3 (the annealing) is set lower than the deformation temperature of the members forming the thermal head.

Figure 13:
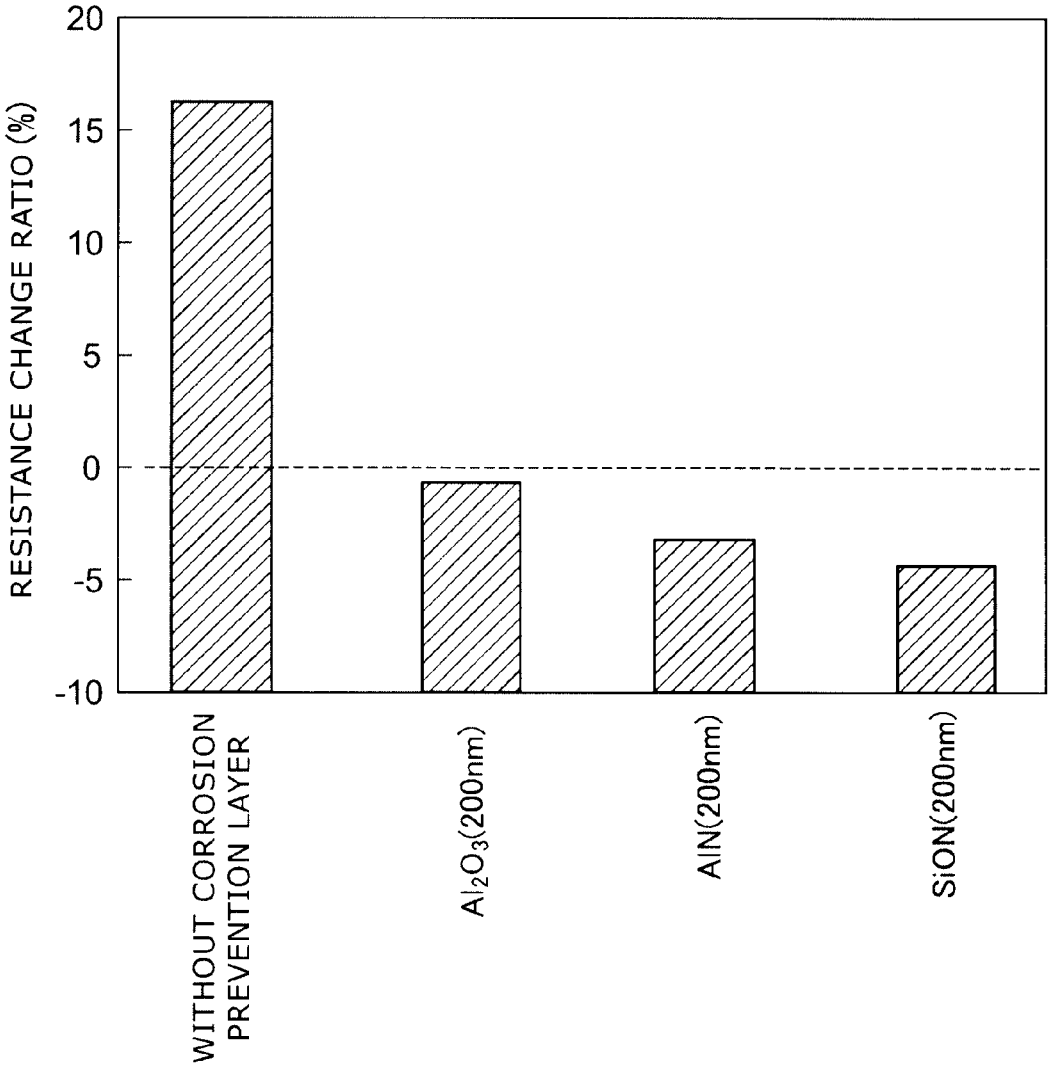
FIG. 13 is a graph illustrating the relationship between the material of a corrosion prevention layer and the resistance value change.

Various materials may be used as the corrosion prevention layer 6 in the first to third embodiments described above such as, for example, aluminum oxide ($Al_2O_3$), aluminum nitride (AlN), and silicon oxynitride ($SiO_xN_y$). FIG. 13 is a graph illustrating the relationship between the material of the corrosion prevention layer and the resistance value change. FIG. 13 illustrates the change in the electrical resistance of the circuit formed of the resistance heating element 4 and the electrodes 5*a* and 5*b* prior to and after the fifth process S5 (the forming the protective layer) without the corrosion prevention layer 6 and for the cases where $Al_2O_3$, AlN, and $SiO_xN_y$ are used as the corrosion prevention layer 6. For better clarity of the effects of the corrosion prevention layer 6, this graph illustrates results of the case without the third process S3 (the annealing). The resistance value change ratio of (R2-R1)/R1 is plotted on the vertical axis of FIG. 13, where the electrical resistance prior to and after the fifth process S5 (the forming the protective layer) (430° C. for 30 minutes) is R1 and R2, respectively.

The resistance heating element 4 undergoes complex effects of the thermal load of the forming the protective layer, namely (1) change (increase of the resistance value) due to reactions of the protective layer with oxygen, etc., (2) diffusion of impurities from the protective layer (increasing the resistance value), and (3) change of the film structure (decrease of the resistance value) of the resistance heating element layer due to annealing.

The resistance value change ratio has a large positive value for the case without the corrosion prevention layer 6 as illustrated in FIG. 13. This result indicates deterioration of the resistance heating element 4 and large effects of (1) change (increase of the resistance value) due to reactions of the protective layer with oxygen, etc., and/or (2) diffusion of impurities from the protective layer (increasing the resistance value).

On the other hand, the resistance value change ratio has a negative value for the cases where $Al_2O_3$, AlN, and $SiO_xN_y$ are used as the corrosion prevention layer 6. This result suggests substantially no effects from (1) change (increase of the resistance value) due to reactions of the protective layer with oxygen, etc., and (2) diffusion of impurities from the protective layer (increasing the resistance value), with the effects mainly due to the phenomenon of (3) change of the film structure (decrease of the resistance value) of the resistance heating element layer due to annealing. This result indicates that a stable resistance heating element 4 can be obtained by using $Al_2O_3$, AlN, or $SiO_xN_y$ as the corrosion prevention layer 6. Thus, the corrosion prevention layer 6 may include at least one of silicon oxynitride, aluminum oxide, and aluminum nitride as a main component of the corrosion prevention layer 6. Of these materials, it can be said that $SiO_xN_y$ provides the lowest resistance value change ratio and is a favorable material.

Various materials may be used as the corrosion prevention layer 6. For example, in addition to $Al_2O_3$, AlN, and $SiO_xN_y$ recited above, the corrosion prevention layer 6 may be appropriately selected from oxides, nitrides, and compounds thereof such as $SiO_2$, $ZrO_2$, $Ta_2O_5$, $Si_3N_4$, and $SiAlO_xN_y$. The thickness of the corrosion prevention layer may be set to 0.01 μm or greater. In addition to sputtering, various methods may be used for the film formation of the corrosion prevention layer such as CVD and vapor deposition.

For the glass frit of the coated glass paste used as the protective layer 7, various known materials may be used. The protective layer 7 may be appropriately selected from oxides, nitrides, oxide salts, etc., or compounds thereof. The organic vehicle binder may be appropriately selected from cellulose derivatives such as ethyl cellulose and nitrocellulose, various acrylate derivatives, or compounds thereof. The solvent may be appropriately selected from various organic solvents such as: various alcohols such as diethylene glycol monobutyl ether, diethylene glycol monobutyl ether acetate, 2,2,4-trimethyl 1,3-hydroxypentyl isobutyrate, diethylene glycol monoethyl ether, tetraisopropyl orthotitanate, 2-butoxyethanol, 2-ethoxy ethanol, α-terpineol, isopropyl alcohol, propanol, toluene, cyclohexane, and methyl ethyl ketone; glycoethers; hydrocarbons; ketone; ester; or compounds thereof.

The anti-wear properties of the protective layer 7 improve in the case where the glass paste includes a filler. In the case where a filler is not included, effects are provided that the planarity of the protective layer 7 improves, the diffusion of impurities from the protective layer 7 to the resistance heating element 4 are suppressed, and reactions between such impurities and the resistance heating element 4 are suppressed.

The contact holes 10 described in these examples may be made by photolithography and etching. The etching may include dry etching such as RIE (Reactive Ion Etching), wet etching, or lift-off instead of etching. The contact holes 10 may be made prior to or after the third process S3 (the annealing), and may be made by conditions appropriate for the manufacturing processes.

Although the thermal heads illustrated in the specific examples described above are applied to ink ribbon printers, the invention is not limited thereto. For example, applications are possible in thermal printers that do not use an ink ribbon.

Hereinabove, exemplary embodiments of the invention are described with reference to specific examples. However, the invention is not limited to these specific examples. The invention may be practiced in methods for manufacturing thermal heads having other structures. Further, one skilled in the art may appropriately select the various materials and/or manufacturing conditions described above in the embodiments and examples from known art and similarly practice the invention. Such practice is included in the scope of the invention to the extent that similar effects thereto are obtained.

Moreover, any two or more components of the specific examples may be combined within the extent of technical feasibility; and are included in the scope of the invention to the extent that the purport of the invention is included.

Furthermore, various modifications and alterations within the spirit of the invention will be readily apparent to those skilled in the art. All such modifications and alterations should therefore be seen as within the scope of the invention.

The invention claimed is:

1. A method for manufacturing a thermal head, comprising:

forming a resistance heating element and an electrode on an insulating substrate, the resistance heating element emitting heat by a current flowing the resistance heating element, the electrode being connected to the resistance heating element;

forming a corrosion prevention layer on the resistance heating element and the electrode;

annealing the resistance heating element;

adjusting an electrical resistance of the resistance heating element; and forming a protective layer on the corrosion prevention layer, the protective layer having glass as a main component, the annealing being implemented prior to the adjusting, and the forming the corrosion prevention layer being implemented prior to the annealing.

2. The method according to claim 1, wherein a maximum temperature of the annealing is not less than a maximum temperature of the forming the protective layer.

3. The method according to claim 1, wherein the corrosion prevention layer includes at least one of silicon oxynitride, aluminum oxide, and aluminum nitride as a main component of the corrosion prevention layer.

4. The method according to claim 1, wherein the protective layer substantially does not contain a filler.

5. The method according to claim 1, wherein a maximum temperature of the annealing is lower than a deformation temperature of a member forming the thermal head.

6. The method according to claim 1, wherein the resistance heating element includes Ta—$SiO_2$.

7. The method according to claim 1, wherein the forming the resistance heating element and the electrode includes forming a resistance heating layer to form the resistance heating element on a protrusion of a glass layer provided on an insulating substrate.

8. The method according to claim 1, wherein the adjusting includes providing a current to the resistance heating element.

9. The method according to claim 1, wherein the forming the protective layer includes coating a glass paste as a film on the corrosion prevention layer and sintering the glass paste.

10. A method for manufacturing a thermal head, comprising:

forming a resistance heating element and an electrode on an insulating substrate, the resistance heating element emitting heat by a current flowing the resistance heating element, the electrode being connected to the resistance heating element;

forming a corrosion prevention layer on the resistance heating element and the electrode;

annealing the resistance heating element;

adjusting an electrical resistance of the resistance heating element; and forming a protective layer on the corrosion prevention layer, the protective layer having glass as a main component, the annealing being implemented prior to the adjusting, and the annealing being implemented in a vacuum or in an inert gas.

11. The method according to claim 10, wherein the forming the corrosion prevention layer is implemented between the annealing and the adjusting.

12. The method according to claim 10, wherein the adjusting is implemented prior to the forming the corrosion prevention layer.

13. The method according to claim 10, wherein a maximum temperature of the annealing is not less than a maximum temperature of the forming the protective layer.

14. The method according to claim 10, wherein the corrosion prevention layer includes at least one of silicon oxynitride, aluminum oxide, and aluminum nitride as a main component of the corrosion prevention layer.

15. The method according to claim 10, wherein the protective layer substantially does not contain a filler.

16. The method according to claim 10, wherein a maximum temperature of the annealing is lower than a deformation temperature of a member forming the thermal head.

17. The method according to claim 10, wherein the resistance heating element includes Ta—$SiO_2$.

18. The method according to claim 10, wherein the forming the resistance heating element and the electrode includes forming a resistance heating layer to form the resistance heating element on a protrusion of a glass layer provided on an insulating substrate.

19. The method according to claim 10, wherein the adjusting includes providing a current to the resistance heating element.

20. The method according to claim 10, wherein the forming the protective layer includes coating a glass paste as a film on the corrosion prevention layer and sintering the glass paste.

* * * * *